US010330038B2

(12) United States Patent
Baehner et al.

(10) Patent No.: US 10,330,038 B2
(45) Date of Patent: Jun. 25, 2019

(54) METHOD FOR ADAPTING THE COMPOSITION OF A MIXTURE OF FUEL AND COMBUSTION AIR

(71) Applicant: Andreas Stihl AG & Co. KG, Waiblingen (DE)

(72) Inventors: Andreas Baehner, Gronau (DE); Michael Dietenberger, Waiblingen (DE); Martin Kiesner, Weinstadt (DE); Florian Hoche, Besigheim (DE); Klaus Geyer, Sulzbach (DE); Steffen Bantle, Korb (DE); Friedrich Hollmeier, Rudersberg (DE); Frederik Herrmann, Waiblingen (DE); Jochen Gantert, Urbach (DE); Karsten Schmidt, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 15/886,705

(22) Filed: Feb. 1, 2018

(65) Prior Publication Data

US 2018/0216554 A1 Aug. 2, 2018

(30) Foreign Application Priority Data

Feb. 1, 2017 (EP) ..... 17400006

(51) Int. Cl.
*F02D 41/06* (2006.01)
*F02D 41/24* (2006.01)
(Continued)

(52) U.S. Cl.
CPC ..... *F02D 41/061* (2013.01); *F02D 31/007* (2013.01); *F02D 35/0053* (2013.01);
(Continued)

(58) Field of Classification Search
CPC ..... F02D 31/003; F02D 41/08; F02D 11/02; F02D 41/16; F02D 2200/10; F02D 2200/101; F02D 2200/1012
(Continued)

(56) References Cited

U.S. PATENT DOCUMENTS 5,226,920 A 7/1993 Andreasson
2006/0021591 A1* 2/2006 Knaus ..... F02P 5/1504 123/155
(Continued)

FOREIGN PATENT DOCUMENTS

WO 2007133125 A1 11/2007

*Primary Examiner* — John Kwon
(74) *Attorney, Agent, or Firm* — Walter Ottesen, P.A.

(57) ABSTRACT

The invention relates to a method for adapting the composition of a mixture of fuel and combustion air. The mixture is supplied to a combustion chamber of a mixture-lubricated combustion engine in a work apparatus. The fuel is supplied to the combustion engine via a controlled fuel valve. In an operating state (I) of the combustion engine, the quantity of fuel is metered by the fuel valve. For the purpose of adapting the composition of the mixture, the combustion engine is shifted into a special operating state (II) which differs from the normal operating state (I). After starting, the combustion engine is operated in a first rotational speed range (B) for a prespecified operating time ($T_{min}$), wherein, after the prespecified operating time ($T_{min}$) has elapsed, the operating state (II) for adapting the composition of the mixture is initiated by a prespecified user action.

19 Claims, 4 Drawing Sheets

(51) Int. Cl.

| | |
|---|---|
| ***F02D 41/30*** | (2006.01) |
| ***F02M 7/10*** | (2006.01) |
| ***F02D 31/00*** | (2006.01) |
| ***F02D 35/00*** | (2006.01) |
| ***F02M 1/08*** | (2006.01) |
| *F02D 1/00* | (2006.01) |
| *F02D 19/06* | (2006.01) |

(52) U.S. Cl.
CPC ..... *F02D 41/062* (2013.01); *F02D 41/068* (2013.01); *F02D 41/2432* (2013.01); *F02D 41/2454* (2013.01); *F02D 41/3076* (2013.01); *F02M 1/08* (2013.01); *F02M 7/10* (2013.01); *F02D 19/0607* (2013.01); *F02D 2001/009* (2013.01); *F02D 2200/604* (2013.01); *F02D 2400/04* (2013.01); *F02D 2400/06* (2013.01)

(58) Field of Classification Search
USPC ..... 123/294, 305, 339.1, 339.13, 123/339.16–339.19, 351
See application file for complete search history.

(56) References Cited

U.S. PATENT DOCUMENTS

| | | | | |
|---|---|---|---|---|
| 2009/0050124 | A1 | 2/2009 | Ooniwa et al. | |
| 2010/0258099 | A1 | 10/2010 | Andersson et al. | |
| 2013/0327285 | A1* | 12/2013 | Burnham | F02D 29/06 123/2 |
| 2018/0222469 | A1* | 8/2018 | Iwase | B60W 20/16 |

* cited by examiner

METHOD FOR ADAPTING THE COMPOSITION OF A MIXTURE OF FUEL AND COMBUSTION AIR

CROSS REFERENCE TO RELATED APPLICATION

This application claims priority of European patent application no. 17 400 006.7, filed Feb. 1, 2017, the entire content of which is incorporated herein by reference.

FIELD OF THE INVENTION

The invention relates to a method for initiating adaptation of the composition of a mixture of fuel and combustion air, wherein the mixture is supplied to a combustion chamber of a mixture-lubricated combustion engine in a work apparatus. At least a partial quantity of the fuel which is supplied to the combustion engine is supplied via an electromagnetically controlled fuel valve, wherein, in an operating state of the combustion engine, the supplied partial quantity of fuel is added in a metered manner by opening and closing the electromagnetic fuel valve depending on operating parameters of the combustion engine.

BACKGROUND OF THE INVENTION

Adapting the mixture comprising fuel and combustion air is dependent to a particular extent on the atmospheric pressure and, more specifically, on the altitude of the site of use of the work apparatus. It is known that the user can use a corresponding work tool to make adjustments to the mixture formation unit of the combustion engine for the purpose of adapting the elevation of the site of work, for example by manually turning the carburetor screw using a work tool such as a screwdriver or the like. This is complicated and requires a work tool to be carried. The mixture comprising fuel and combustion air is expediently also adapted when components of the work apparatus have been cleaned or replaced, such as an air filter which purifies the combustion air for example.

SUMMARY OF THE INVENTION

It is an object of the invention to provide a method for adapting the composition of a mixture comprising fuel and combustion air, which method can be initiated by the user in a simple manner without a special work tool.

According to the invention, the object is achieved in that, in a method for adapting the composition of a mixture comprising fuel and combustion air, which mixture is supplied to the combustion chamber of a mixture-lubricated combustion engine, at least a partial quantity of the fuel is supplied to the combustion engine via an electromagnetically controlled fuel valve and, in an operating state of the combustion engine, the supplied partial quantity of fuel is added in a metered manner by the electromagnetic fuel valve depending on operating parameters by way of the composition of the mixture being adapted in a special operating state which differs from the operating state of the combustion engine and, for the purpose of initiating the special operating state, the combustion engine being initially started by the user and, after starting, being operated in a first rotational speed range for a prespecified operating time and, after the prespecified operating time has elapsed, the special operating state for adapting the composition of the mixture being initiated by a user action.

First of all, it is provided that the adaptation of the composition of the mixture is executed in a special operating state which differs from the operating state of the combustion engine. In order to initiate this special operating state of the combustion engine, the user initially has to start the combustion engine and, after starting, operate the combustion engine in a first rotational speed range for a prespecified operating time. Once the prespecified operating time has elapsed and the first rotational speed range is maintained during the first operating time, the user can initiate the special operating state by a simple user action for the purpose of adapting the composition of the mixture. An expedient user action may comprise pressing the throttle lever and/or the locking lever once or several times.

The user advantageously does not perform any further actions during the first operating time of the combustion engine and leaves the combustion engine in its operating state.

A user action for initiating the special operating state expediently involves the rotational speed of the combustion engine being increased to a second rotational speed range by the user action. The second rotational speed range advantageously lies above the first rotational speed range and is achieved in a simple manner by the user operating the combustion engine in the second rotational speed range under full throttle. The user can therefore initiate the special operating state after the prespecified operating time has elapsed by pressing down the throttle lever of the work apparatus, in particular pressing down the throttle lever completely, that is, applying full throttle. In the process, the internal combustion engine is operated in the first and/or second rotational speed range, in particular in a load-free manner.

Starting of the combustion engine is, in particular, cold starting, so that the combustion engine is operated in the first rotational speed range after cold starting with starting gas during the prespecified operating time. The machine runs warm and in a conditioned manner in this first rotational speed range.

In order to initiate the user action, a time window expediently opens after the prespecified operating time has elapsed. After the prespecified operating time has elapsed, the time window extends over a time period advantageously of from 15 seconds to 360 seconds, in particular over a time period of from 30 seconds to 90 seconds, particularly advantageously of from 30 seconds to 60 seconds. If no prespecified user action is performed within the time window, the combustion engine is operated in the normal operating state.

The calibration or adaptation of the composition of the mixture is performed, in particular, in a plurality of successive calibration steps. In this case, the mixture can be adapted at nominal rotational speed of the combustion engine in a first calibration step. The first calibration step advantageously serves to adjust the maximum power of the work apparatus.

In an advantageously following second calibration step, the mixture is adapted at the maximum rotational speed of the combustion engine.

In an embodiment of the invention, provision is made to enable a third calibration step if the first and the second calibration step have been successfully completed. In a third calibration step of this kind, the mixture can be adapted for idling. The third calibration step can advantageously be carried out only under prespecified further boundary conditions, for example only with connection of a diagnosis apparatus.

During the adaptation of the mixture in the different calibration steps, provision is made to terminate the special operating state and switch off the combustion engine if one calibration step is not successfully completed. This serves, for example, as feedback to the user that the calibration of the machine was not successful.

If the calibration step is successfully completed, the user receives corresponding feedback, for example a reduction in the rotational speed n of the combustion engine to a rotational speed which advantageously lies below the second rotational speed range. The rotational speed $n_{feedback}$ advantageously lies above the first rotational speed range and below the second rotational speed range. It may be expedient in the case of successful completion of, for example, the third calibration step to switch off the combustion engine by means of the control unit.

The supplied partial quantity of fuel is added in a metered manner, in particular by clocked opening of the electromagnetic fuel valve by a control unit. The total quantity of fuel which is supplied to the combustion air is advantageously added in a metered manner via the electromagnetic fuel valve.

The mixture in the combustion chamber is ignited by the ignition sparks of a spark plug which is actuated by a control unit. In order to adjust the nominal rotational speed of the combustion engine, it is advantageously provided to adjust the rotational speed by suppressing the ignition spark. This is also called "desynchronization".

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
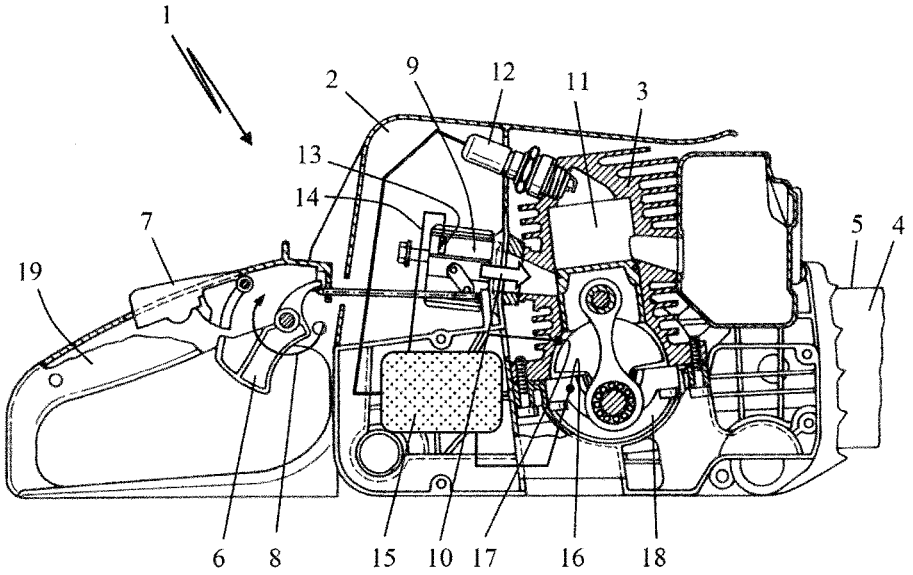
FIG. 1 is a schematic sectional view through a first work apparatus comprising a combustion engine.

The work apparatus 1 shown in FIG. 1 is a chain saw 2 including a combustion engine 3 which drives, as work tool 5, a saw chain which revolves on a guide bar 4. The rotational speed of the combustion engine 3 is controlled by a user by way of a throttle lever 6 which has an associated throttle lever lock 7. For the purpose of increasing the rotational speed of the combustion engine 3, the throttle lever 6 can advantageously then first be pressed down in arrow direction 8 towards full throttle when the throttle lever lock 7 is actuated. The throttle lever 6 and the throttle lever lock 7 are provided in a rear handle 19 of the work apparatus 1.

In the embodiment shown, the combustion engine 3 is a preferably mixture-lubricated combustion engine, in particular a two-stroke engine, a mixture-lubricated four-stroke engine or the like. The combustion engine 3 is, in particular, a single-cylinder combustion engine.

For the purpose of operating the combustion engine 3, a mixture 10 comprising fuel and combustion air is supplied by a mixture formation unit 9. The mixture 10 fills a combustion chamber 11 of the combustion engine 3 and is ignited by a spark plug 12 by way of an ignition spark being outputted.

At least a partial quantity of the fuel, which is supplied to the inflowing combustion air by means of the mixture formation unit 9, is added in a metered manner via an electromagnetic fuel valve 13. In an operating state I of the combustion engine 3, which can also be called the normal operating state, the composition of the mixture 10 is changed by controlling the electromagnetic fuel valve 13 in dependence upon operating parameters. To this end, a control unit 15, which is supplied with the rotational speed of the combustion engine 3 as a first operating parameter by a rotational speed sensor 16 for example, can be provided. The pressure in the crankcase 18 and/or the temperature in the crankcase 18 can be reported to the control unit 15 as further operating parameters by a further sensor 17. The list of operating parameters is exemplary; it is possible for more or fewer operating parameters to be processed in the control unit 15.

The control unit 15 is connected to the fuel valve 13 via a control line 14. The control unit 15 controls the opening time of the fuel valve 13. The opening time of the fuel valve 13 determines the supplied partial quantity of fuel which is supplied to the combustion engine.

The fuel valve 13 is expediently a clocked fuel valve, that is, the fuel valve 13 is opened and closed by applying a clock frequency; by virtue of changing the clock frequency, the total opening duration of the fuel valve 13 can be adjusted and therefore the quantity of fuel flowing to the mixture formation unit, in particular a partial quantity of fuel, can be added in a metered manner.

The fuel valve 13 is advantageously an electromagnetic fuel valve which is open when no current is applied. An electromagnetic fuel valve which is closed when no current is applied can also be advantageous.

The delivery of the fuel to the mixture formation unit 9 is performed, in particular, above the negative pressure which is present in the intake channel of the mixture formation unit 9; if the fuel valve 13 is open, fuel is drawn in.

Figure 2:
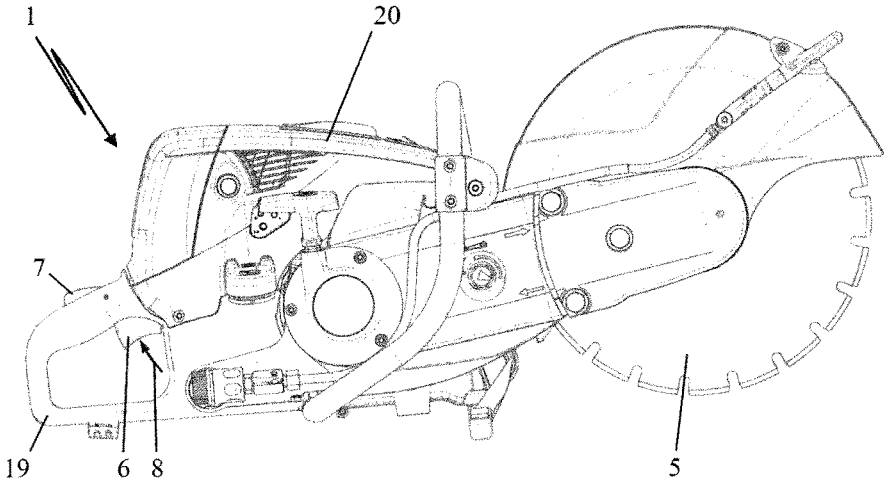
FIG. 2 shows a side view of a further work apparatus comprising a combustion engine.

The embodiment of a work apparatus shown in FIG. 2 is a cut-off machine 20, a combustion engine corresponding to FIG. 1 being arranged in the housing of the cut-off machine. The rotational speed of this combustion engine can also be controlled by the throttle lever 6, wherein the throttle lever 6 can advantageously be pivoted in arrow direction 8 toward full throttle only after actuation of the throttle lever lock 7. The throttle lever 6 and the throttle lever lock 7 are provided in a rear handle 19 of the work apparatus 1.

In combustion engines 3 of this kind, the mixture 10 comprising fuel and combustion air changes depending on the atmospheric pressure and/or depending on the altitude of the site of use of the work apparatus 1. If the density of the combustion air changes, the mixture 10 would become too rich with the same quantity of fuel added in a metered manner; therefore, before commissioning the work apparatus 1, it is practical to calibrate the mixture formation unit 9 in such a way that the composition of the mixture 10 comprising fuel and combustion air is matched to the atmospheric pressure and/or to the altitude of the site of use of the work apparatus 1.

Figure 3:
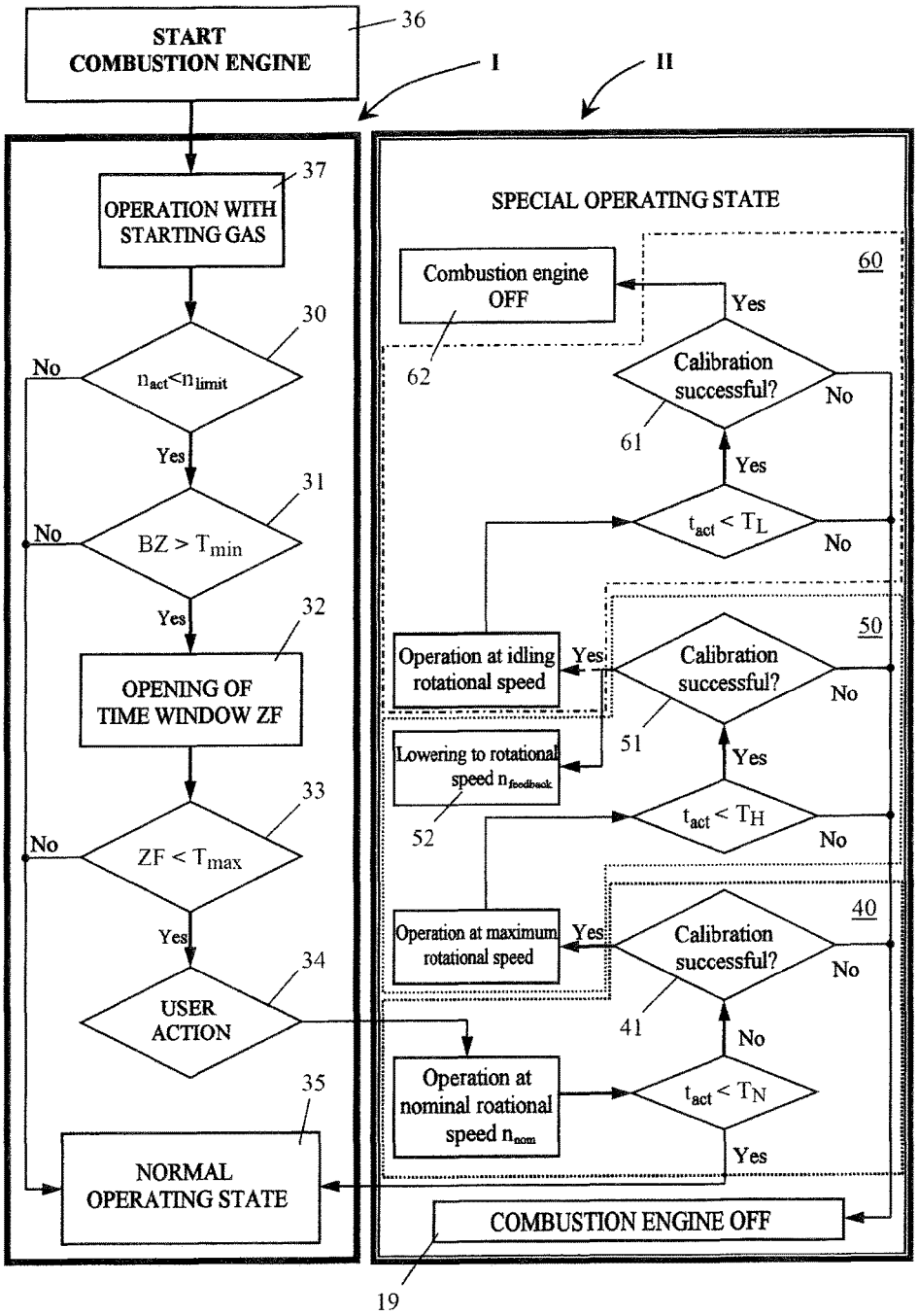
FIG. 3 shows a flowchart for adapting the composition of a mixture comprising fuel and combustion air for a combustion engine.

In line with the method according to the invention as per the flowchart in FIG. 3, the combustion engine 3 is moved from a first operating state I to a second operating state, which corresponds to a special operating state II, for the purpose of initiating the process of adapting the composition of the mixture 10 comprising fuel and combustion air. In the special operating state II, the mixture formation unit 9 is calibrated and the composition of the mixture 10 comprising fuel and combustion air is adapted. The first operating state I can also be called the normal operating state of the combustion engine, in which normal operating state the work apparatus is used as intended.

The process of adapting the composition of the mixture 10 comprising fuel and combustion air is initiated depending on at least one prespecified user action, in particular by means of the operator control elements which are provided for operating the work apparatus 1, such as the throttle lever 6 and/or the throttle lever lock 7 for example. In order to arrive at a special operating state II, which is necessary for adapting the composition of the mixture 10, from the first operating state I of the combustion engine 3, the combustion engine 3 first has to be started by the user. In this case, starting of the combustion engine 3 is expediently cold starting. A corresponding cold starting flap or the like can be operated on the mixture formation unit 9 for the purpose of cold starting. Cold starting is understood to mean first starting of the combustion engine, in which starting operation the combustion engine 3 is at most at ambient temperature during starting. If the combustion engine 3 is at ambient temperature, it can be assumed that the combustion engine 3 is being commissioned for the first time. This corresponds to cold starting.

Figure 4:
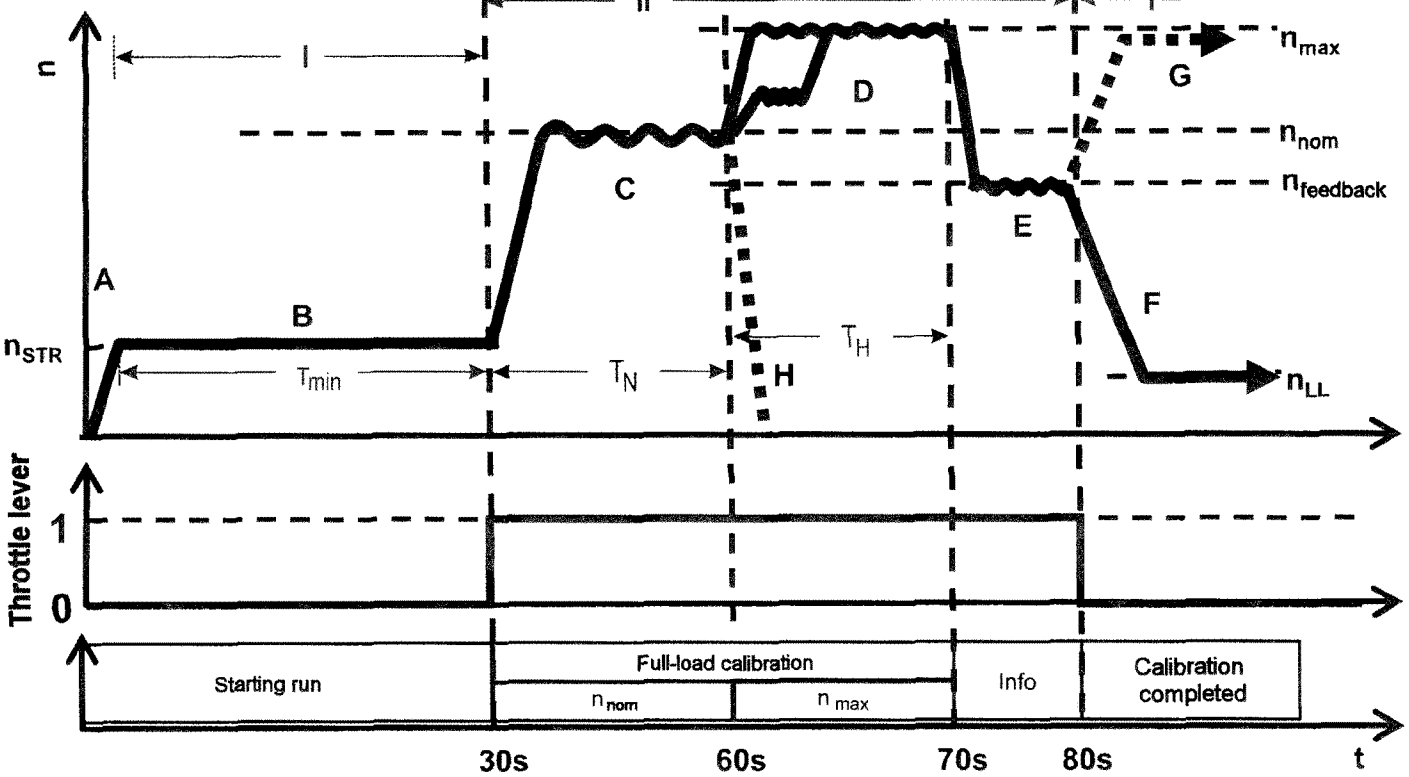
FIG. 4 shows a schematic representation of a method sequence of a plurality of successive calibration steps; and, FIG. 5 is a schematic of a method sequence of successive calibration steps with a calibration step for adapting the mixture at idle rotational speed.
Figure 5:
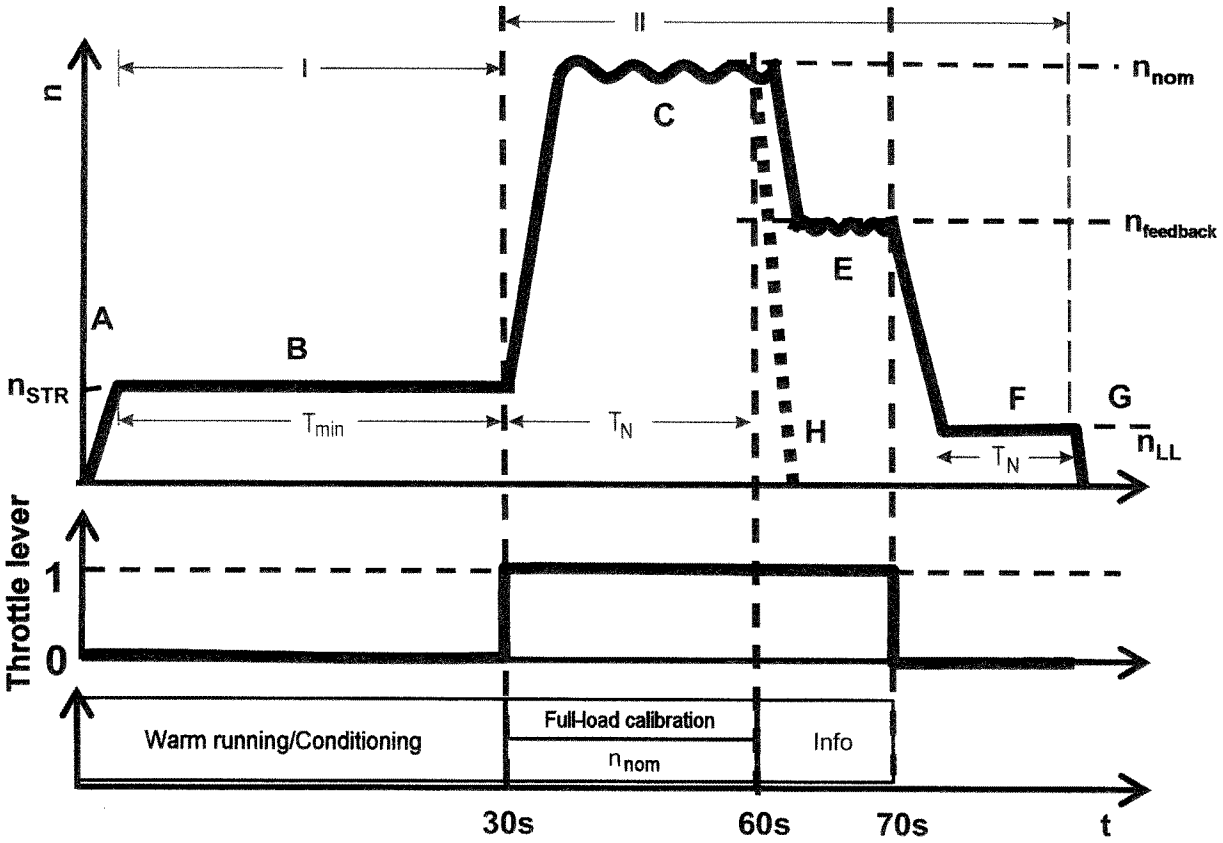

After starting of the combustion engine 3 shown in field 36 in FIG. 3, the combustion engine has to be operated for a prespecified operating time BZ of the duration $T_{min}$ in a first rotational speed range. This first rotational speed range can be determined by a prespecified rotational speed band and/or by a limit rotational speed $n_{limit}$, as shown in the left-hand column of FIG. 3. During this operating time BZ, for example with starting gas, a check is made to determine whether the actual rotational speed $n_{act}$ is lower than a prespecified limit rotational speed $n_{limit}$. When a rotational speed band is prespecified, the lower limit of the rotational speed band, for example a minimum rotational speed, can also be checked. If the prespecified condition is met, operation is performed in the first rotational speed range B, as shown in FIGS. 4 and 5. The maximum limit rotational speed $n_{limit}$ can correspond to a starting rotational speed $n_{STR}$.

In accordance with the flowchart in FIG. 3, operation with starting gas is initially established in field 37. The actual rotational speed $n_{act}$ is, as shown in a first decision rhombus 30, monitored at least to check that a prespecified limit rotational speed $n_{limit}$ is not exceeded. Thereafter, a check is made, as shown by decision rhombus 31, to determine whether the actual rotational speed $n_{act}$ is lower than the limit rotational speed $n_{limit}$ over a prespecified minimum operating time $T_{min}$. If this condition is met, a time window ZF is opened according to field 32. The time window ZF according to field 32 has an upper time limit $T_{max}$ which, as shown in the decision rhombus 33, is monitored. If the time limit $T_{max}$ is reached without a prespecified user action being executed, the combustion engine 3 continues to run in a normal operating state, the first operating state I. This first operating state I is indicated in field 35. The combustion engine 3 is always operated in the first operating state I when the result of the checks according to the decisions in the decision rhombuses 30, 31 and 33 is answered with "No".

If the time window ZF according to decision rhombus 33 is open and the user executes a prespecified user action, this is checked in the process sequence, as shown in the decision rhombus 34. If a prespecified user action is established, a changeover is made from the operating state I to the special operating state II.

The established user action, see rhombus 34 in FIG. 3, expediently leads to an increase in the rotational speed $n_{act}$ of the combustion engine 3 into a second rotational speed range C and/or D (FIGS. 4, 5). As shown in FIGS. 4 and 5, the second rotational speed range C and/or D lies above the first rotational speed range B. In particular, the user action is given by the user completely pressing down the throttle lever 6 in arrow direction 8; the combustion engine is therefore operated by the user under full throttle in the second rotational speed range C and/or D. At the position "full throttle" of the throttle lever 6, the special operating state II is initiated and the full throttle position is maintained—preferably by the user—until the combustion engine 3 provides the user with feedback that the calibration was successful.

With the initiation of the special operating state II, the user keeps the throttle lever 6 permanently operated, advantageously pushed up to an end stop, this corresponding to a full throttle position. It may be advantageous for the control unit 15 to take over control of the combustion engine 3 with the initiation of the special operating state II by a prespecified user action and for the method for adapting the composition of the mixture 10 comprising fuel and combustion air to be automatically carried out until an end of the method.

Provision can also be made for the user to have to carry out the prespecified user action permanently over a prespecified time period in order to initiate the special operating state II. Following this, the combustion engine 3 in conjunction with the control unit 15 can automatically carry out the method for adapting the composition of the mixture 10 comprising fuel and combustion air until an end of the method.

Within the scope of the invention, starting of the combustion engine 3 can also be warm starting. Starting after previous running of the combustion engine 3 is called warm starting. The combustion engine 3 can be at a temperature which is higher than the ambient temperature. If a user wishes to adapt the composition of a mixture 10 comprising fuel and combustion air after warm starting, he can carry out the warm starting in a starting position of the mixture formation device 9 for the purpose of initiating the special operating state. The warm starting is identified by the control unit 15 and then detected as first starting of the combustion engine 3. If the user does not perform any further user actions during the first operating time, the combustion engine 3 is operated for a prespecified operating time $T_{min}$ in a first rotational speed range B in a first operating state. After the operating time $T_{min}$ has elapsed, the time window ZF for jumping to a special operating state II is opened after execution of a prespecified user action, for example full throttle being applied.

The composition of the mixture 10 comprising fuel and combustion air is adapted, in particular, in a load-free manner, that is, without loading on the work tool 5. For example, in the embodiment according to FIG. 1, a saw chain is fitted on the guide rail as work tool 5, but the method for adapting the mixture is carried out only when the saw chain is not being used for cutting wood. The saw chain can run concomitantly in a load-free manner. The same applies, for example, for a work apparatus according to FIG. 2.

The method for adapting the composition of a mixture 10 comprising fuel and combustion air is advantageously performed in a plurality of calibration steps 40, 50, 60. According to the embodiment, the composition of the mixture 10 comprising fuel and combustion air is adapted in three calibration steps 40, 50, 60, in particular in an automated manner without further mandatory user actions, after the special operating state II (FIG. 3) is initiated.

On account of the user action "full throttle" prespecified in the embodiment, the combustion engine 3 initially runs at a nominal rotational speed $n_{nom}$. This operation at nominal rotational speed $n_{nom}$ has to be performed for a minimum time $T_N$. During this minimum time $T_N$, calibration is performed in the first calibration step 40 at nominal rotational speed $n_{nom}$. This nominal rotational speed $n_{nom}$ is—even under full throttle—achieved by desynchronization of the ignition. The mixture 10 in the combustion chamber 11 is ignited by ignition sparks of the spark plug 12 which is actuated by an ignition device, in the embodiment the control unit 15. The nominal rotational speed $n_{nom}$ is regulated by suppression of the ignition spark by the control unit 15. The combustion engine 3 is adjusted down to the nominal rotational speed $n_{nom}$.

After the first calibration step 40 is concluded, a check is made according to the decision rhombus 41 to determine whether the calibration was successful. If no fault is established, the method branches in the manner shown in the decision rhombus 41. The method branches to the second calibration step 50 in branch "Yes". If the calibration was not successful, the method branches to field 19 via the "No" branch according to the decision rhombus 41 and the combustion engine 3 is switched off.

If the first calibration step 40 was completed successfully, the rotational speed $n_{act}$ of the combustion engine 3 increases to a maximum rotational speed $n_{max}$. This rotational speed range of the maximum rotational speed $n_{max}$ advantageously lasts for a minimum time $T_H$. During this minimum time $T_H$, calibration is performed in the second calibration step 50 for the purpose of further adapting the mixture 10 comprising fuel and combustion air. As shown in the decision rhombus 51, a check is then made in the method to determine whether the calibration in the second calibration step 50 was successful. In the event of a fault in the second calibration step 50, the decision rhombus 51 branches to the "No" branch which leads to field 19 and to the combustion engine 3 being switched off.

As an alternative, the calibration can be completed after successful completion of the second calibration step 50. The successful calibration is reported to the user by feedback. As feedback to successful calibration, the rotational speed of the combustion engine 3 can be lowered to a feedback rotational speed $n_{feedback}$ as shown in field 52. It can also be expedient to switch off the combustion engine as feedback to the user.

If the calibration was also successful in the second calibration step 50, the third calibration step 60 can advantageously be enabled only under prespecified further boundary conditions. For example, it may be necessary to permit the third calibration step 60 to be carried out only when a diagnosis apparatus is connected. The third calibration step 60 can expediently be started up only during servicing at a workshop. The mixture is calibrated at idling rotational speed $n_{LL}$ in the third calibration step 60. If the third calibration step 60 was successfully completed, the combustion engine 3 is preferably switched off, as shown in field 62.

In order to report back to the user about the successful calibration of the combustion engine 3 after successful completion of the calibration steps 40 and 50 on-site, the rotational speed n of the combustion engine 3 is advantageously lowered to a feedback rotational speed $n_{feedback}$ after completion of the second calibration step 50. The feedback rotational speed $n_{feedback}$ is advantageously lower than $n_{max}$, in particular lower than $n_{nom}$. The feedback rotational speed $n_{feedback}$ is preferably greater than $n_{STR}$ and, respectively, $n_{LL}$, but, in particular, can be zero and can be achieved by switching off the combustion engine 3.

After the feedback, the user—if he is still keeping the throttle lever 6 pressed—can release the throttle and move the throttle lever 6 to the idling position against arrow direction 8. As an alternative, the composition of a mixture 10 comprising fuel and combustion air can then be adapted in the idle state in the calibration step 60. As shown in the decision rhombus 61, a check is then made to determine whether the calibration of the third calibration step 60 was successful. If a fault occurred, the method branches to field 19 via the "No" branch and the combustion engine 3 is switched off. If the calibration of the third calibration step 60 was successful, the combustion engine 3 is advantageously switched off. Switching off the combustion engine serves as feedback to the user, wherein it is possible to read out, in particular via a connected diagnosis apparatus, whether the calibration was successful.

One example of the method sequence for adapting the composition of a mixture 10 comprising fuel and combustion air is shown in a first advantageous embodiment in FIG. 4. In section A, the combustion engine 3 is started using starting gas, as a result of which the combustion engine 3 runs at a starting rotational speed $n_{STR}$. The starting rotational speed $n_{STR}$ corresponds to a limit rotational speed $n_{limit}$. This starting run has to last for a fixed operating time BZ of the duration $T_{min}$ of, in the embodiment, 30 seconds, so that the time window ZF for the purpose of initiating the special operating mode II is opened.

If the user operates the throttle lever 6, in particular applies full throttle, within this time window ZF indicated in FIG. 3, the rotational speed n increases to the rotational speed $n_{nom}$. In a first calibration step 40, so-called full-load calibration takes place in this second rotational speed range C at increased rotational speed n. The combustion engine is advantageously adjusted down at a defined rotational speed during the full-load calibration. During the adjustment down, the ignition is advantageously desynchronized and the mixture adapted. If the adjustment criterion, for example a prespecified rotational speed, cannot be achieved in the second rotational speed range C of the calibration step 40, the calibration is aborted due to lowering of the rotational speed in accordance with falling flank H. In particular, the rotational speed n falls to 'zero'. The combustion engine 3 is switched off.

If the calibration in the second rotational speed range C was successful, the desynchronization of the ignition is suppressed, so that—since the user is advantageously applying full throttle in an unchanged manner—the combustion engine 3 runs up to a maximum rotational speed $n_{max}$. During this further second rotational speed range D at increased rotational speed, the mixture is calibrated in the high rotational speed range in the second calibration step 50.

If the second calibration step 50 is successfully completed in the further, second rotational speed range D, the rotational speed n of the combustion engine 3 is advantageously lowered to a feedback rotational speed $n_{feedback}$ in a method section E by means of the control unit 15. This significant reduction in the rotational speed is advantageously performed by the control unit 15 even though full throttle continues to be applied by the user, as shown in the profile of the throttle lever position over time. According to the switching indicator in FIG. 4, the throttle lever is in position "1", that is, in the "full throttle" position, in method step E too.

When the feedback rotational speed $n_{feedback}$ is identified, the user releases the throttle in section F; the throttle lever 6 moves to the idling position and the combustion engine 3 runs at the idling rotational speed $n_{LL}$. The combustion engine 3 is matched to changed boundary conditions, for example matched to the altitude of the site of use or the prevailing atmospheric pressure or to newly installed replacement parts or to a cleaned air filter, by the calibration.

It is left to the user to keep the rotational speed at a maximum rotational speed $n_{max}$ in section G by continuing to apply full throttle.

FIG. 5 shows an alternative method sequence for initiating a method for adjusting the composition of a mixture 10 comprising fuel and combustion air. According to FIG. 5—the combustion engine 3 is started under starting gas in section A; the combustion engine 3 is run up to starting rotational speed $n_{STR}$ The rotational speed range B is maintained for an operating time BZ with a duration $T_{min}$ of 30 seconds as indicated in the embodiment; after the minimum operating time BZ has elapsed, the time window ZF is open according to field 32 in FIG. 3. The user moves the throttle lever from the position "0" (idling) to the position "1" (full throttle), as shown in the view of the throttle lever position over time beneath the rotational speed profile. The rotational speed n of the combustion engine 3 is run up to a nominal rotational speed $n_{nom}$ and calibration is carried out over a time period $T_N$ of advantageously 30 seconds. If the calibration in the second rotational speed range C over the minimum time $T_N$ is faulty, the rotational speed according to the falling flank H drops to 0. The combustion engine 3 turns off. If the calibration is successful, the rotational speed drops to a feedback rotational speed $n_{feedback}$ in section E under the action of the control unit 15—in spite of the position of the throttle lever at "1" (full throttle). The user identifies completed calibration and releases the throttle; the throttle lever assumes the position "0" (idling). The combustion engine 3 falls to the idling rotational speed $n_{LL}$. In the rotational speed range F, idling calibration according to calibration step 60 in FIG. 3 can now take place, the combustion engine 3 being switched off after the idling calibration is successfully completed. The mixture 10 which is supplied to the combustion engine 3 is matched to the density of the combustion air.

It is understood that the foregoing description is that of the preferred embodiments of the invention and that various changes and modifications may be made thereto without departing from the spirit and scope of the invention as defined in the appended claims.

What is claimed is:

1. A method for adapting the composition of a mixture of fuel and combustion air supplied to a combustion chamber of a mixture-lubricated combustion engine in a portable work apparatus carried and guided by a user, the method comprising the steps of:

supplying at least a component quantity of fuel to the combustion engine via an electromagnetically controlled fuel valve;

metering the supplied component quantity of fuel via the electromagnetic fuel valve in a first operating state (I) of the combustion engine in dependence upon operating parameters;

carrying out the adapting of the composition of the mixture in a special second operating state (II) diverging from the first operating state (I) of the combustion engine wherein the user first starts the combustion engine to initiate the second operating state (II);

after the start, operating the combustion engine for a predetermined operating time ($T_{min}$) in a first rpm range (B); and, after the predetermined operating time ($T_{min}$) elapses, initiating the second operating state (II) for adapting the composition of the mixture by action of the user.

2. The method of claim 1, wherein the action of the user effects an increase of the rpm of the combustion engine in a second rpm range (C,D).

3. The method of claim 2, wherein the second rpm range (C,D) lies above the first rpm range (B).

4. The method of claim 2, wherein the combustion engine is operated at full throttle in the second rpm range (C,D).

5. The method of claim 1, wherein the combustion engine is operated without load in an rpm range (B,C,D).

6. The method of claim 1, wherein the start of the combustion engine is a cold start.

7. The method of claim 6, wherein after the cold start, the combustion engine is operated in the first rpm range (B) with start gas during the predetermined operating time ($T_{min}$).

8. The method of claim 1, wherein a time window (ZF) opens after the predetermined operating time ($T_{min}$) elapses.

9. The method of claim 8, wherein the time window (ZF) extends over a time span of 15 to 360 seconds after the predetermined operating time ($T_{min}$) elapses.

10. The method of claim 8, wherein the combustion engine is operated in the first operating state (I) outside of the time window (ZF).

11. A method for adapting the composition of a mixture of fuel and combustion air supplied to a combustion chamber of a mixture-lubricated combustion engine in a work apparatus guided by a user, the method comprising the steps of:

supplying at least a component quantity of fuel to the combustion engine via an electromagnetically controlled fuel valve;

metering the supplied component quantity of fuel via the electromagnetic fuel valve in a first operating state (I) of the combustion engine in dependence upon operating parameters;

carrying out the adapting of the composition of the mixture in a special second operating state (II) diverging from the first operating state (I) of the combustion engine wherein the user first starts the combustion engine to initiate the second operating state (II);

after the start, operating the combustion engine for a predetermined operating time ($T_{min}$) in a first rpm range (B);

after the predetermined operating time ($T_{min}$) elapses, initiating the second operating state (II) for adapting the composition of the mixture by action of the user; and, wherein the adapting of the composition of the mixture takes place in a first calibration stage and in a second calibration stage.

12. The method of claim 11, wherein the adapting of the mixture takes place in the first calibration stage at a rated rpm ($n_{nom}$) of the combustion engine.

13. The method of claim 11, wherein the adapting of the mixture takes place in the second calibration stage at a highest rpm ($n_{max}$) of the combustion engine.

14. The method of claim 11, wherein a third calibration stage is enabled upon successful completion of said first and second calibration stages.

15. The method of claim 14, wherein the adapting of the mixture takes place in the third calibration stage at idle rpm ($n_{LL}$).

16. The method of claim 11, wherein the second operating state (II) is ended after successful completion of a calibration stage.

17. The method of claim 15, wherein the combustion engine is switched off after successful completion of the third calibration stage.

18. The method of claim 1, wherein the supplied component of fuel is metered via a clocked opening of the electromagnetic fuel valve by a control unit.

19. The method of claim 18, wherein the mixture in the combustion chamber is ignited by a spark of a spark plug which is driven by the control unit and a rated rpm ($n_{nom}$) free of load is controlled by suppressing the ignition spark.

* * * * *